United States Patent [19]

Waldron et al.

[11] 4,120,556

[45] Oct. 17, 1978

[54] ELECTRICAL CONTACT ASSEMBLY

[75] Inventors: Clifford R. Waldron; Karl W. Yonkers, both of Unadilla; Herbert K. Uhlig, Bainbridge, all of N.Y.

[73] Assignee: The Bendix Corporation, Southfield, Mich.

[21] Appl. No.: 662,677

[22] Filed: Mar. 1, 1976

[51] Int. Cl.[2] ..... H01R 11/08

[52] U.S. Cl. ..... 339/142; 113/119; 339/276 T; 29/629

[58] Field of Search ..... 339/252, 256, 258, 259, 339/262, 275, 276; 113/119

[56] References Cited

U.S. PATENT DOCUMENTS

| | | | |
|---|---|---|---|
| 2,689,337 | 9/1954 | Burtt et al. | 339/275 T |
| 2,804,602 | 8/1957 | Vizcarrondo | 339/256 R |
| 3,125,396 | 3/1964 | Bertram | 339/258 R |
| 3,137,925 | 6/1964 | Wahl | 339/276 R |
| 3,314,044 | 4/1967 | Powell | 339/276 R |
| 3,316,528 | 4/1967 | Juris et al. | 339/259 R |
| 3,317,887 | 5/1967 | Henschen et al. | 339/276 T |
| 3,648,224 | 3/1972 | McDonough | 339/276 T |
| 3,660,805 | 5/1972 | McDonough | 339/276 R |
| 3,721,943 | 3/1973 | Curr | 339/276 T |
| 3,920,310 | 11/1975 | Walsh et al. | 339/275 T |

FOREIGN PATENT DOCUMENTS

| | | | |
|---|---|---|---|
| 60,347 | 2/1968 | Fed. Rep. of Germany | 339/276 T |

*Primary Examiner*—Joseph H. McGlynn
*Attorney, Agent, or Firm*—Raymond J. Eifler

[57] ABSTRACT

A cylindrical electrical contact assembly that is stamped and rolled into shape from a flat sheet of metal. The electrical contact assembly provides a secure electrical and mechanical connection when crimped to a wire without the need for welding or brazing a seam (31) that results from forming the contact. A plurality of axially arranged slots (32) arranged in the wire receiving end of the contact assembly allow the contact assembly to distort symmetrically when a wire is crimped inside the contact.

30 Claims, 21 Drawing Figures

FIG. 15
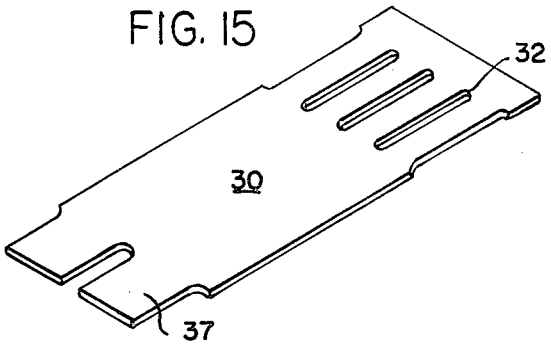
FIG. 19
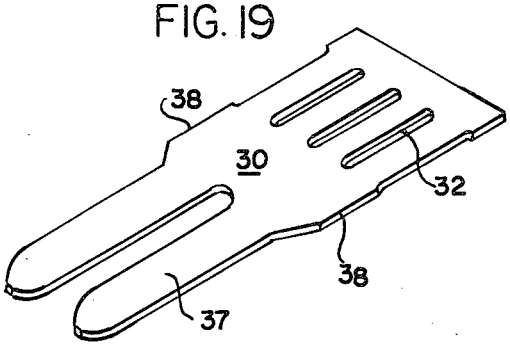
FIG. 16
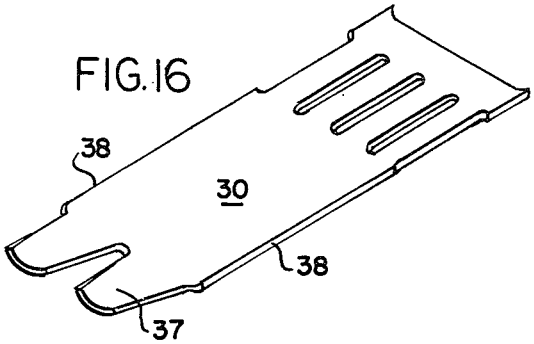
FIG. 17
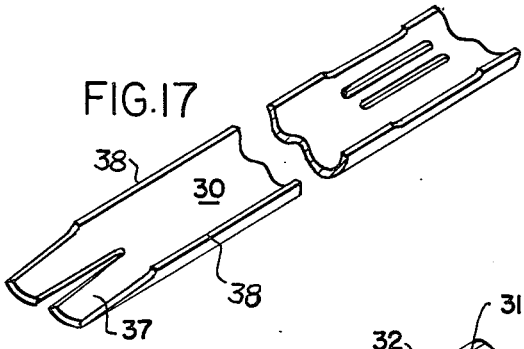
FIG. 18
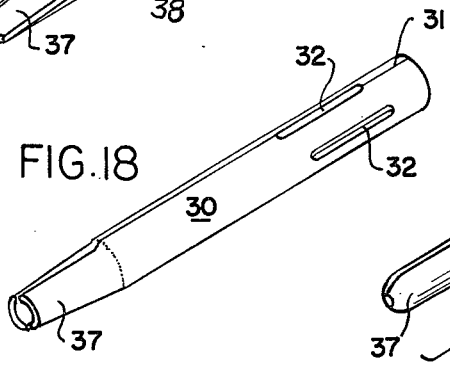
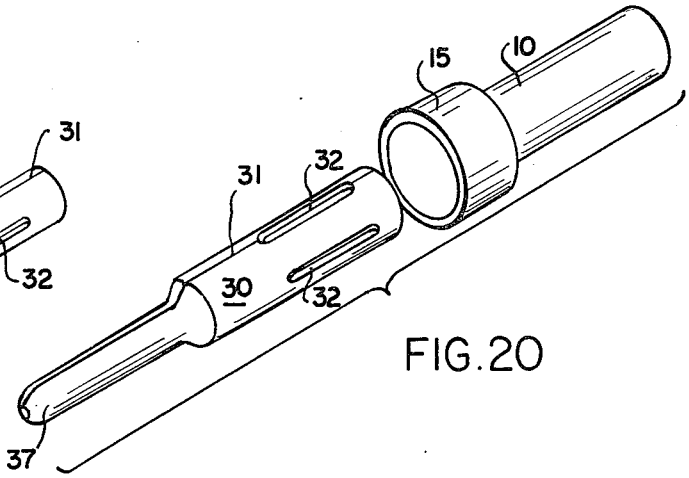
FIG. 20
FIG. 21
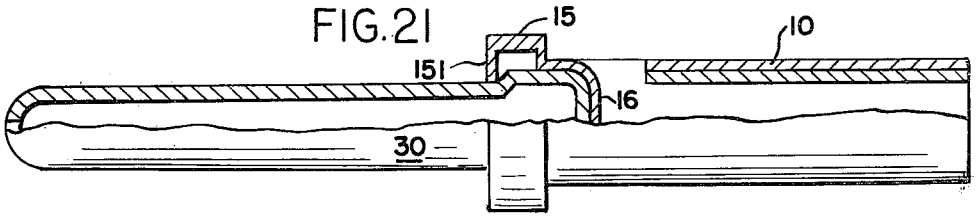

ELECTRICAL CONTACT ASSEMBLY

CROSS-REFERENCE TO RELATED APPLICATION

This application is related to patent application Ser. No. 662,678 filed on Mar. 1, 1976 entitled "Electrical Contact Assembly", the inventors being Clifford R. Waldron, Karl W. Yonkers, Robert Goebeler, David L. Frear and Edward J. Bright

BACKGROUND OF THE INVENTION

This invention relates to electrical connectors of the type having a shell or housing; a plurality of contacts, each of which are connected to separate incoming wires; and a dielectric insert assembly for fixedly or removably mounting the electrical contacts in the connector shell. The invention is more particularly related to the electrical contact assembly and a method of making the electrical contact assembly.

Electrical connectors are utilized in electrical instrumentation to connect together the multiplicity of wires carrying electrical power and signals within and between different electrical instruments making up the system or systems. In the aerospace field, as electronic systems become more and more complex, they are miniaturized to minimize their weight and size. Hence, the electrical connectors interconnecting the systems must also be reduced in size. In some instances, electrical connectors which are no more than a few inches in diameter (called "miniature connectors"), carry hundreds of electrical contacts which interconnect hundreds of wires. Each of the contacts and wires associated with such a connector are quite small (about one-half an inch long with a diameter of about 0.092 inches). The wires which are terminated to these contacts generally have a diameter less than about 0.040 inches.

Generally, each of the contacts within the connector is removable so that it may be connected (by crimping) to an incoming wire when the electronic equipment is installed. Each of the incoming wires to the connector is attached to the contact by inserting the electrical wire into an axial opening in one end of the contact and then crimping the contact to the wire to obtain an electrical and mechanical connection. The crimping operating is performed by a well known plier type tool that, when squeezed, applies pressure simultaneously to two pairs of diametrically opposed points in the circumference of the contact to deform the contact wall into the wire within the contact. After the crimping operation, each of the contacts is inserted into the connector insert where they are retained by a contact retention mechanism.

Generally, electrical contacts are machined from metal stock and because of their small size, the contacts are machined to tolerances of 0.002 of an inch or less. A contact which is oversized for any reason cannot be utilized becaue it may not be possible to insert such a contact into the contact receiving holes in the connector insert or insufficient clearance between contacts could cause an electrical or mechanical problem. One example of an electrical connector having many removable contacts is shown in U.S. Pat. No. 3,721,943 entitled "Electrical Connecting Device", issued Mar. 20, 1973 to Maurice D. Curr.

Machining of electrical contacts is expensive and, because of the large number of contacts utilized by the connector, the connector is expensive. To reduce the cost of manufacturing a connector and at the same time provide an electrical contact that provides a secure electrical and mechanical connection when a wire was crimped to the contact, many inventors have turned to making an electrical contact by stamping and rolling (forming) the electrical contact from a sheet of metal. Examples of such contacts may be found in the following three U.S. patents hereby specifically incorporated by reference: U.S. Pat. No. 3,286,223 entitled "Ferrule Construction and a Method for Producing Same" issued Nov. 15, 1966 to Ronald S. Narozny and Charles C. Anderson; U.S. Pat. No. 3,317,887 entitled "Contact Socket" issued May 2, 1967 to Homer E. Henschen and Marvin L. Yeager; and U.S. Pat. No. 3,721,943 entitled "Electrical Connecting Device" issued Mar. 20, 1973 to Maurice D. Curr.

In each of the foregoing patents, the inventors found it necessary to weld or braze the joint or seam that resulted when the contact was formed by rolling the flat stock. In the Curr patent, the abutting edges of the seam were brazed together. In the Narozny patent the edges that formed the seam were overlapped and spot welded together. As pointed out in the Curr patent, the seam is brazed so that the end portion of the contact is continuous around its circumference without any break therein. This approach enabled the end of the contact to be crimped to the end of a wire irrespective of the rotational position of the contact relative to the crimping tool. In most connectors used by the military and the aircraft industry, the wire is crimped to the contact at four points (about 90° apart). As pointed out in the Curr patent, when the free ends are not attached (not welded or brazed) to each other, the action of the edges of the open seam in the contact become displaced with respect to each other during the crimping operation so that a secure electrical and mechanical connection to the wire and contact does not occur. In addition to this, the crimping operation on a contact having an unbrazed or unwelded (open) seam can cause the end portion of the contact to distort unsymmetrically so that it becomes oversized and cannot be properly inserted into its position in the electrical connector. An example of a prior art stamped and formed contact that has an unwelded and unbrazed (open) seam and has been crimped is shown in FIG. 1 of this patent.

Therefore, there have been attempts to replace machined contacts with less expensive electrical contacts stamped and formed from a sheet of metal. In addition to this, inventors have been searching for practical alternatives to brazing or welding the seam that occurs in a contact formed from a stamping. The difficulty of welding or brazing the seam is emphasized when on considers that the sheet metal from which the contact is formed is only about 0.005 inches thick and the longitudinal seam is only a very small part of the contact diameter of about 0.048 inches (about the diameter of paper clip wire).

SUMMARY OF THE INVENTION

This invention is an electrical connector contact assembly that is stamped and rolled from a flat sheet of metal. The contact assembly provides a secure mechanical and electrical contact when a wire is crimped to the electrical contact without the need to braze or weld the seam resulting from forming the cylindrical contacts from flat stock.

The invention is an electrical connector contact assembly that is stamped and formed from a piece of sheet metal and is characterized by the fact that the cylindrical contact formed from the sheet metal does not have any brazed or welded seams but rather, includes a plurality of elongated slots (32) in the wire receiving portion of the contact. In one specific embodiment of the invention, the electrical contact is made of three pieces: an inner sleeve (30); an intermediate sleeve (20); and an outer sleeve (10); the inner sleeve (30) has an open (unwelded) seam (31) and four axial slots (32) in the wire receiving portion that are spaced 90° apart around the circumference of the inner sleeve (30). It is the slots (32) that the inventor believes provides some sort of stress relief when a wire is crimped within the contact so that the contact deforms symmetrically in the manner shown in FIG. 2.

Accordingly, it is an object of this invention to eliminate the need to weld or braze the seam in an electrical contact stamped and formed from a flat sheet of metal.

It is also an object of this invention to replace expensive machined electrical cntacts with inexpensive electrical contacts that are stamped and formed from a sheet of metal.

It is also an object of this invention to provide an electrical contact stamped and formed from a sheet of metal which, when crimped to a wire, will provide a secure mechanical and good electrical connection to the wire.

It is another object of this invention to provide an electrical contact assembly that is stamped and formed from a sheet of metal which, when crimped to an electrical wire, does not distort unsymmetrically so that it may be easily inserted into the contact receiving passage of an electrical connector mounting insert.

It is still another object of this invention to provide an electrical contact that can be fabricated relatively easy in large quantities at a low cost.

It is still a further object of this invention to provide an inexpensive electrical connector that contains electrical contacts that are stamped and formed from a single sheet of metal.

The above and other objects and features of the invention will become apparent from the following detailed description taken in conjunction with the accompanying drawings and claims which form a part of this specification.

BRIEF DESCRIPTION OF THE DRAWINGS

FIGS. 15, 16, 17 and 18 illustrate the process by which a socket type contact is formed from a sheet of flat metal.

FIGS. 19, 20 and 21 illustrate the process by which a pin type contact is formed from a sheet of flat metal.

DETAILED DESCRIPTION OF THE DRAWING SHOWING THE PRIOR ART PROBLEM

Figure 1:
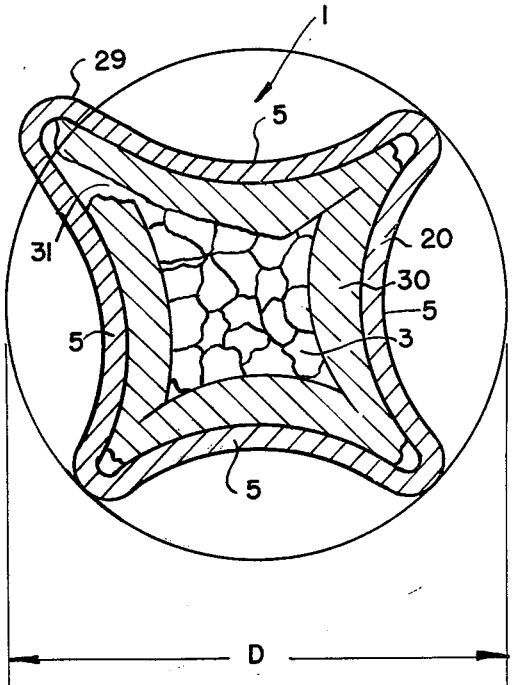
FIG. 1 PRIOR ART
FIG. 1 is a cross-sectional view of a PRIOR ART electrical contact having a wire crimped therein.

FIG. 1 illustrates a cross-sectional view of a PRIOR ART contact assembly having a wire crimped therein. A cylindrical contact assembly 1 having a diameter D has been crimped 5 at four points around its circumference. The crimping operation distorts sleeve 20 and inner sleeve 30 so that the inner sleeve 30 is in pressure (air) tight contact with a wire 3 within the inner sleeve. The crimping operation electrically and mechanically connects the inner sleeve 30 to the wire 3. FIG. 1 further illustrates that if the seam 31 of the inner sleeve 30 is not brazed or welded, distortion of the contact assembly 1 occurs during the crimping operation so that a portion of the contact assembly 29 distorts unsymmetrically causing the original diameter D of the contact assembly to be exceeded. Electrical contact assemblies which are distorted so that their originally predetermined diameter D is exceeded cannot be utilized within the connector assembly.

DETAILED DESCRIPTION OF THE DRAWINGS ILLUSTRATING THE INVENTION

Figure 2:
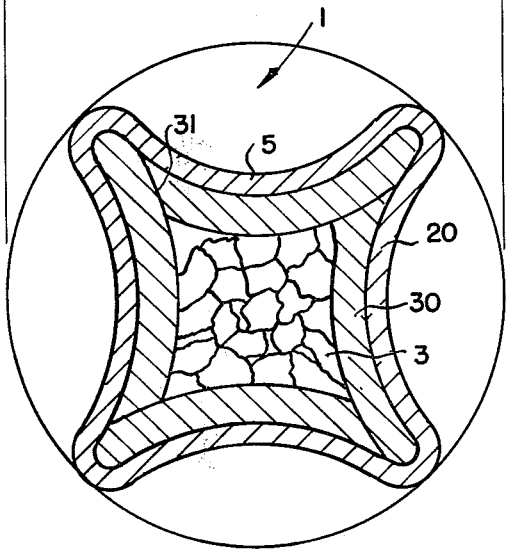
FIG. 2 is a cross-sectional view of an electrical contact incorporating the objects of this invention which has a wire crimped therein.

FIG. 2 illustrates a cross-sectional view of an electrical contact assembly incorporating the objects of this invention. In FIG. 2 the contact assembly 1 has been crimped 5 at four points around its circumference but has not distorted unsymmetrically so as to cause the contact assembly to exceed diameter D. The crimping operation forces the outer sleeve 20 and inner sleeve 30 inwardly into the wire 3 to form an electrical and mechanical connection between the inner sleeve 30 and the wire 3. The inner sleeve 30 is stamped and formed from a sheet of metal into a cylindrical contact assembly without the necessity of welding a seam 31 in the inner sleeve 30.

The feature of the inner sleeve 30 that makes it unnecessary to weld or braze a seam in the stamped and formed inner sleeve 30 are the slots 32 shown in the remaining figures.

Figure 3:
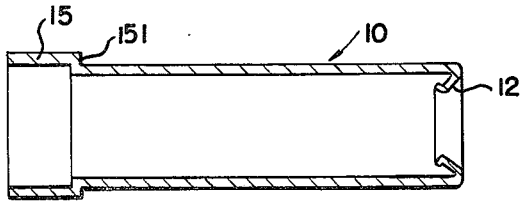
FIGS. 3, 4, 5 and 6 are views illustrating the three pieces that comprise an electrical socket type contact assembly incorporating the principles of this invention.
Figure 4:
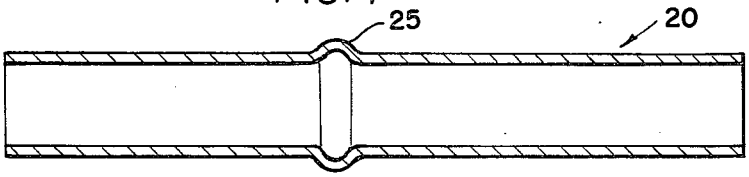
Figure 5:
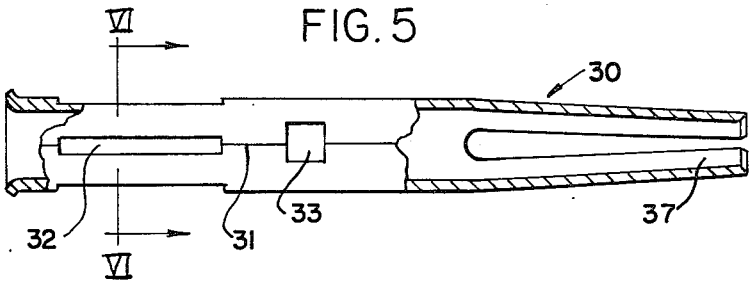

FIGS. 3, 4 and 5 illustrate the components that make up an electrical socket contact assembly for an electrical connector.

FIG. 3 illustrates an outer sleeve 10 which is fabricated by drawing a piece of metal (e.g. stainless steel) through a die to obtain a sleeve having a diameter of about 0.078 inches with a wall thickness of about 0.004 inches. The rear of the sleeve is then formed to provide an enlarged rear portion 15 having a forwardly facing shoulder 151. The front portion of the sleeve is then formed to provide a tapered entry 12 for guiding a male pin type electrical contact into the bore of the sleeve 10.

FIG. 4 illustrates an intermediate sleeve 20 that is formed by drawing a piece of metal (e.g. stainless steel) through a die to obtain a sleeve having a diameter of about 0.058 inches with a wall thickness of about 0.005 inches. The intermediate sleeve 20 is generally fabricated from a stainless steel to provide the necessary mechanical strength to the complete contact assembly and includes an enlarged or raised portion 25 having a diameter of about 0.083 inches.

FIG. 5 illustrates the inner sleeve 30 which is stamped and formed from a sheet of beryllium copper material having a wall thickness of about 0.005 inches. In some instances, the sleeve 30 has a gold plating thereon to provide good electrical current carrying characteristics. In one type of contact assembly the inner sleeve 30 has a diameter of about 0.048 inches and is about 0.491 inches long. The inner sleeve 30, when initially stamped and formed, includes an axial seam 31 that extends its entire length. The seam 31 is referred to as an "open seam" because the abutting edges that form the seam are not mechanically bonded together by brazing or welding. The edges of the open seam 31, since they are not bonded, can be separated by the application of a mechanical force, such as that applied by a crimping tool. The inner sleeve 30 also includes a forward portion having a plurality of spring fingers 37 which are resiliently deflectable in a radial direction. The forward portion of the inner sleeve 30 with the spring fingers 37 forms the front portion of the socket contact for receiving a male pin type electrical contact. Intermediate of the inner sleeve 30 is an opening 33 that is referred to as an inspection hole that permits visual inspection as to whether or not there is anything in the bore of the inner sleeve 30. The inspection hole 33 is optional as the hole may also be formed by punching a hole through the inner sleeve.

Figure 6:
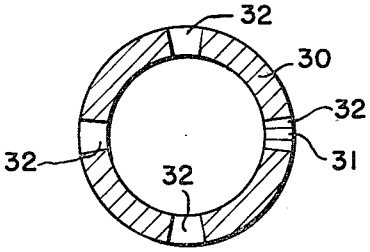

FIG. 6 illustrates a cross-sectional view of the inner sleeve 30 taken along lines VI—VI of FIG. 5. In the preferred embodiment of the invention wherein the contact assembly is utilized in a connector and crimped in four places, the inventors believe that it is preferred to have four slots 32 arranged symmetrically (90° apart) around the circumference of the inner sleeve 30. Further, the inventors suggest that one of the slots 32 should intercept the open seam 31 in the inner sleeve 30. The inventors have observed from microphotographs that inner sleeves 30 having such an arrangement of slots 32 provide the symmetrically crimped wire contact arrangement shown in FIG. 2.

Figure 7:
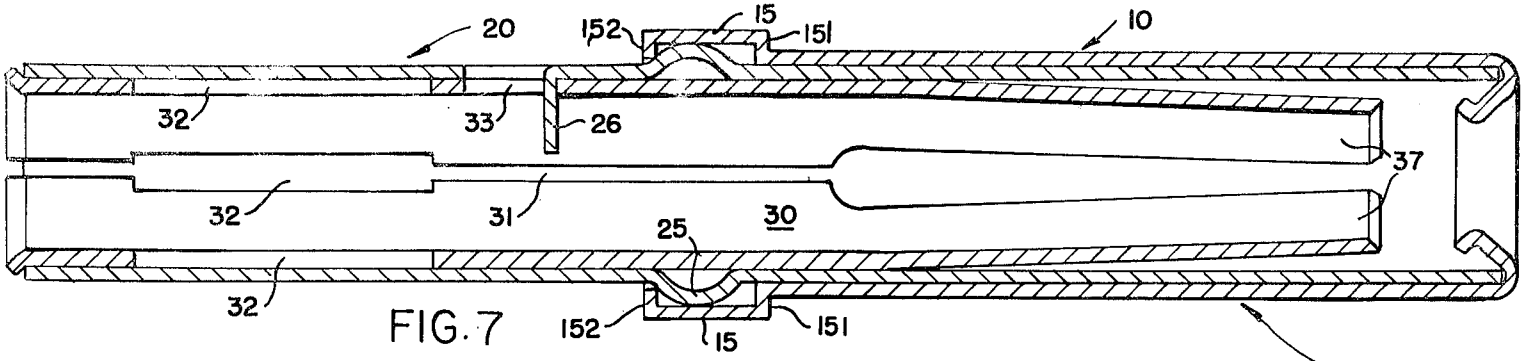
FIG. 7 illustrates a cross-sectional view of a preferred embodiment of an electrical contact assembly incorporating the principles of the invention.

FIG. 7 illustrates a cross-sectional view of an electrical contact assembly 1 incorporating the principles of this invention. FIG. 7 illustrates the contact assembly 1 before a wire is inserted into the contact assembly and crimped thereto. FIG. 7 illustrates the location of the outer sleeve 10 over the intermediate sleeve 20 and the location of the intermediate sleeve 20 over the inner sleeve 30. In this embodiment, the intermediate sleeve 20 includes a radially inwardly extending finger 26 that extends through the aperture 33 in the inner sleeve. It is the function of this inwardly extending finger 26 to provide an internal wire stop means within the bore of the inner sleeve 30. Alternately, the wire stop means could be provided by punching radially inwardly extending fingers from both the inner sleeve 30 and the intermediate sleeve 20. Such an operation would automatically result in the formation of the inspection hole 33. The enlarged portion 25 of the intermediate sleeve 20 aids in the formation of the rearward facing shoulder 152 on the enlarged portion 15 of the outer sleeve 10.

Figure 8:
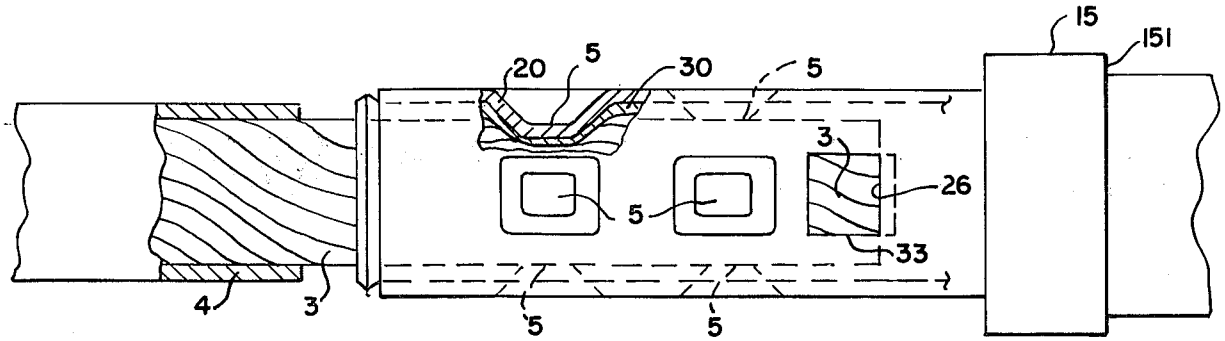
FIG. 8 illustrates a wire crimped to a contact after insertion of the wire into the receiving end of the contact.

FIG. 8 illustrates a partial diagrammatic view of a portion of the contact assembly with a wire inserted in the rear wire receiving end of the contact assembly and crimped thereto. The insulation 4 around an electrical wire 3 has been removed from a portion of the electrical wire 3 and the bare portion of the electrical wire has been inserted into the rear portion of the contact assembly until it abuts against the inwardly extending finger 26. The inspection hole 33 permits visual verification that the wire 3 has extended beyond the crimping points 5 in the rear of the contact assembly. A partial cut-away view shows one of the crimping points 5 and the distortion of the intermediate sleeve 20 so that it crushes the inner sleeve 30 into the wire to form a good electrical and mechanical connection.

Figure 9:
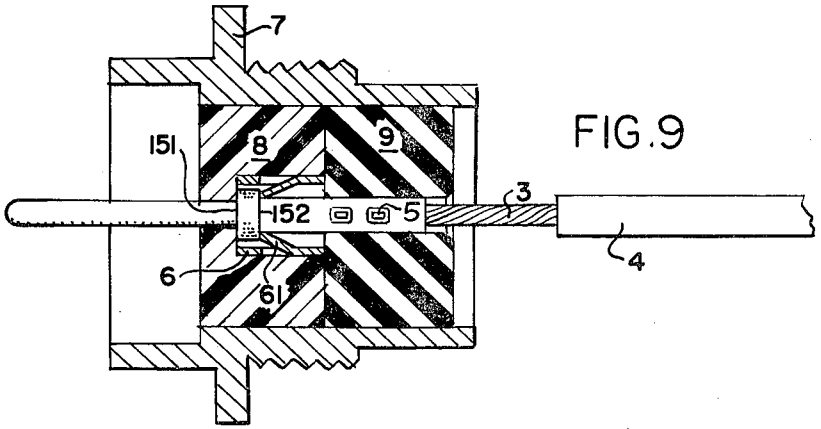
FIG. 9 illustrates a diagrammatic cross-sectional view of an electrical connector.

FIG. 9 is a diagrammatic illustration of an electrical connector assembly of the type having several electrical pin type or socket type contacts mounted therein. For the purposes of clarity, only one such type contact is shown. An electrical connector assembly generally includes a cylindrical metal shell 7 that has mounted therein a dielectric insert. In this illustration the dielectric insert is composed of two pieces 8 and 9. The forward piece 8 includes a contact retention mechanism 6. The contact retention mechanism 6 includes a plurality of deflectable spring fingers 61 that engage the rearwardly facing shoulder 152 of the contact assembly while a rearwardly facing shoulder in the forward insert 8 contacts the forwardly facing shoulder 151 of the contact assembly thereby maintaining the electrical contact assembly 1 in a fixed position within the insert 8.

FIGS. 10 through 14 illustrate the assembly of an electrical contact assembly.

Figure 10:
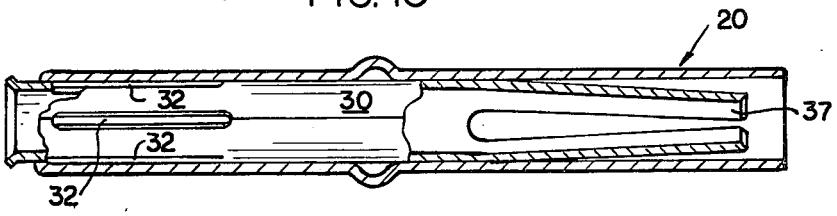
FIGS. 10, 11, 12, 13 and 14 illustrate the assembly of one embodiment of the invention.

FIG. 10 illustrates how the intermediate sleeve 20 is telescopically located over the inner sleeve 30.

Figure 11:
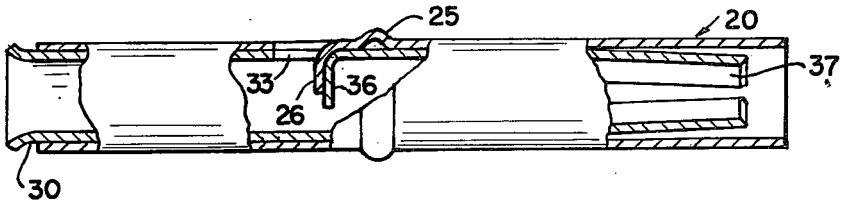

FIG. 11 illustrates how an inspection hole 33 and a wire stop mechanism is formed within the bore of the inner sleeve 30 by punching inwardly a portion of the intermediate sleeve 20 and inner sleeve 30 to form fingers 26 and 36.

Figure 12:
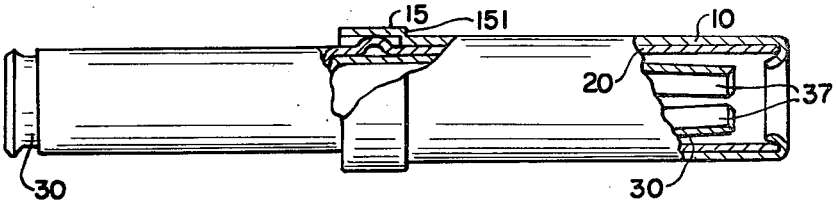

FIG. 12 illustrates how the outer sleeve 10 is inserted over the forward portion of the intermediate sleeve 20 to provide the contact assembly with the forward facing shoulder 151 necessary for retention of the contact within the connector insert.

Figure 13:
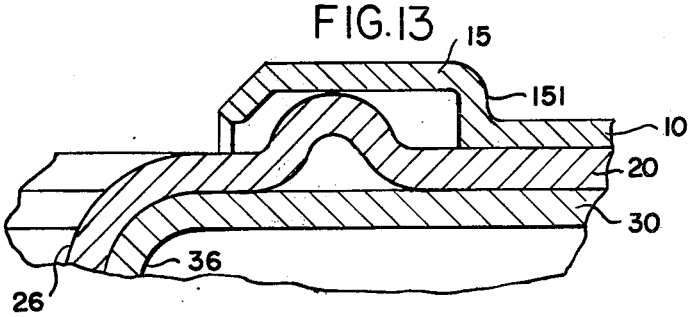
Figure 14:
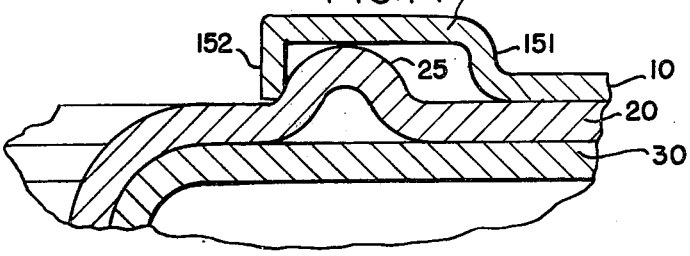

FIGS. 13 and 14 illustrate how the rearwardly shoulder 152 is formed by first bending a portion of the rear end of the enlarged portion 15 at an angle and then further bending the end to obtain a 90° angle and the rearwardly facing shoulder 152.

STAMPING AND FORMING OF THE ELECTRICAL CONTACT

FIGS. 15 through 18 illustrate the steps associated with stamping and forming the inner sleeve of a cylindrical socket contact assembly.

FIG. 15 illustrates the original configuration of the inner sleeve 30 of a socket contact assembly when the sleeve 30 is stamped out of a sheet of flat metal. The stamping may be accomplished in one step wherein the overall shape of the contact is stamped out as well as stamping out the slots 32 and the forward fingers 37 which will be formed into a socket that receives a pin type electrical contact.

FIG. 16 illustrates the next step in the process wherein the longitudinal edges 38 and the fingers 37 are partially rolled.

FIG. 17 illustrates the next step in the process wherein the inner sleeve 30 is rolled to a greater extent than the previous step.

FIG. 18 illustrates the final configuration of the inner sleeve 30 after the sleeve has been completely formed to obtain a cylindrical sleeve 30 that has a longitudinal seam 31 and spring fingers 37 that receive a pin type electrical contact.

FIGS. 19 through 21 illustrate how a pin type electrical contact is formed from a stamping.

FIG. 19 shows the configuration of the pin type electrical contact after it has been stamped from a sheet of flat metal. The stamping includes a plurality of apertures 32 and forwardly projecting fingers 37.

FIG. 20 illustrates the stamping completely formed into a pin type electrical contact 30. The forwardly projecting portions 37 in this instance have been rolled together to form the cylindrical pin type electrical contact. The stamped and rolled pin type electrical contact also includes seam 31 formed by abutting edges 38. Telescopically located over the inner sleeve 30 is an outer sleeve 10 which, together with the inner sleeve 30, form the pin type electrical contact assembly. The outer sleeve 10 includes a raised portion 15.

FIG. 21 is a cross-sectional view of a complete pin type electrical contact assembly. The outer sleeve 10 is fixedly positioned over the rear portion of the pin type electrical contact by the forwardly facing shoulder 151 and the inwardly extending finger 16 that extends into the bore of the inner sleeve 30.

While a preferred embodiment of the invention has been disclosed, it will be apparent to those skilled in the art that changes may be made to the invention as set forth in the appended claims, and, in some instances, certain features of the invention may be used to advantage without corresponding use of other features. For example, the drawings illustrate socket contact assemblies although they could just as well be pin type contact assemblies. Further, although only four axial slots 32 are shown in the rear portion of the contact assembly to provide the necessary stress relief during the crimping operation to prevent unsymmetrical distortion of the contact assembly, additional slots may be provided. Further, the stress relief may be provided by 10 or 20 apertures arranged in the rear wire receiving portion of the inner sleeve 10. The only limit on the number of apertures in the rear wire receiving portion is dictated by the electrical conductivity requirements (minimum voltage drop) between the inner sleeve 30 and wire 3 when the inner sleeve is crimped to the wire. Certainly, too many apertures would eliminate much of the conducting material necessary to make good electrical contact.

Accordingly, it is intended that the illustrative and descriptive materials herein be used to illustrate the principles of the invention and not to limit the scope thereof.

What is claimed is:

1. A one piece unitary electrical contact stamped and formed from a sheet of metal, said contact comprising:

a sleeve having an open seam extending the entire axial length of said sleeve, said sleeve having a front mating portion, and a rear wire receiving portion having at least four slots in the wall thereof, with the longitudinal axis of each slot extending parallel to the longitudinal axis of said sleeve, said slots symmetrically arranged around the longitudinal axis of said sleeve.

2. An electrical socket type contact for receiving a pin type contact, said socket contact comprising:

a sleeve stamped and formed from a sheet of metal, said sleeve having:

a front pin receiving portion having a plurality of axially extending fingers that are resiliently deflectable in a radial direction upon insertion of the pin type contact into the socket type contact; and a rear wire receiving portion having at least four slots in the wall thereof, with the longitudinal axis of each slot extending parallel to the longitudinal axis of said sleeve, said slots symmetrically arranged around the longitudinal axis of said sleeve.

3. An electrical pin type contact for insertion into a socket type contact, said pin type contact comprising:

a sleeve stamped and formed from a sheet of metal, said sleeve having:

a front pin portion for mating with a socket contact; and a rear wire receiving portion having at least four slots in the wall thereof, with the longitudinal axis of each slot extending parallel to the longitudinal axis of said sleeve, said slots symmetrically arranged around the longitudinal axis of said sleeve.

4. An electrical contact assembly for receiving an electrical wire; said electrical contact assembly comprising:

an inner sleeve stamped and formed from a sheet of metal, said sleeve having a front portion, a rear wire receiving portion having a plurality of axially extending slots therein, said slots equally spaced from each other with the longitudinal axis of each of said slots parallel to the longitudinal axis of said sleeve, and an unwelded seam extending the entire axial length of said rear portion;

an intermediate sleeve telescopically mounted over said inner sleeve, said intermediate sleeve having a front portion and a rear portion; and an outer sleeve telescopically mounted on the front portion of said intermediate sleeve, said outer sleeve having a enlarged portion that includes a forwardly facing shoulder and a rearwardly facing shoulder.

5. An electrical contact assembly as recited in claim 4 wherein said plurality of axially extending slots includes at least four axial slots, one of said slots being located in the path of an open seam in said inner sleeve and wherein said intermediate sleeve includes an enlarged portion between said front and rear portions and the enlarged portion of said outer sleeve surrounds the enlarged portion of said intermediate sleeve.

6. An electrical contact assembly as recited in claim 5 including:

wire stop means in the bore of the inner sleeve to prevent a wire inserted into the rear wire receiving portion of said inner sleeve from entering into the front portion of said inner sleeve.

7. An electrical contact assembly as recited in claim 6 wherein the front portion of the inner sleeve includes a plurality of axially extending fingers that are resiliently deflectable in a radial direction upon the insertion of a pin type contact into the bore of the inner sleeve.

8. An electrical contact assembly as recited in claim 6 wherein said wire stop means includes a radially extending finger on said intermediate sleeve that extends into the bore of said inner sleeve.

9. In combination with an electrical connector assembly of the type having a housing; an electrically nonconducting insert mounted within the housing, said insert including a plurality of bores extending therethrough, a plurality of electrical contact assemblies; and means for retaining each of said contact assemblies in a respective bore of said insert, the improvement wherein the electrical contact assembly comprises:

an inner sleeve stamped and formed from a sheet of metal having a front portion, and a rear wire receiving portion having a plurality of axially extending slots therein;

an intermediate sleeve telescopically mounted over said inner sleeve, said intermediate sleeve having a front portion, a rear portion and an enlarged portion between said front and rear portions of said intermediate sleeve; and an outer sleeve telescopically mounted on the front portion of said intermediate sleeve, said outer sleeve having an enlarged portion that includes a forwardly facing shoulder.

10. The combination recited in claim 9 wherein said slots are symmetrically arranged about the axis of said inner sleeve.

11. The electrical contact assembly as recited in claim 9 wherein said plurality of axially extending slots includes at least four slots symmetrically arranged in the wall of the wire receiving portion of said inner sleeve.

12. The combination recited in claim 11 wherein said slots are symmetrically arranged about the axis of said inner sleeve.

13. The electrical contact assembly as recited in claim 9 wherein said inner sleeve is stamped and formed from a sheet of metal, said inner sleeve having an open seam extending the entire axial length of the sleeve.

14. The electrical contact assembly as recited in claim 13 wherein said plurality of axially extending slots includes four slots symmetrically arranged in the wall of the wire receiving portion of said inner sleeve.

15. The electrical contact assembly as recited in claim 13 wherein said inner sleeve includes an aperture located between said axial slots and said enlarged portion; and wire stop means in the bore of the inner sleeve to prevent a wire inserted into the rear wire receiving portion of said inner sleeve from entering into the front portion of said inner sleeve.

16. The electrical contact assembly as recited in claim 15 wherein said plurality of axially extending slots includes at least four slots symmetrically arranged in the wall of the wire receiving portion of said inner sleeve.

17. The electrical contact assembly as recited in claim 15 wherein said wire stop means comprises a radially inwardly extending finger on said intermediate sleeve that extends through the aperture in said inner sleeve and into the bore of said inner sleeve.

18. The electrical contact assembly as recited in claim 17 wherein said plurality of axially extending slots includes at least four slots symmetrically arranged in the wall of said inner sleeve.

19. An electrical connector assembly comprising:

a cylindrical housing;

a dielectric insert mounted within said cylindrical housing, said insert having a plurality of axial bores therein;

means for mounting an electrical contact in each of said axial bore; and a plurality of electrical contact assemblies each mounted in a respective bore by said contact mounting means, said electrical contact assemblies comprising:

an inner sleeve stamped and formed from a sheet of metal having a front portion, a rear wire receiving portion having a plurality of apertures extending through the wall thereof, said apertures symmetrically arranged around the longitudinal axis of said inner sleeve;

an intermediate sleeve telescopically mounted over said inner sleeve, said intermediate sleeve having a front portion and a rear portion; and an outer sleeve telescopically mounted on the front portion of said intermediate sleeve, said outer sleeve having an enlarged portion that includes a forwardly facing shoulder.

20. An electrical contact as recited in claim 19 wherein the plurality of apertures includes a first aperture and a second aperture located opposite the first aperture.

21. An electrical connector assembly as recited in claim 19 wherein the plurality of apertures in said inner sleeve comprises axially extending slots.

22. The electrical contact assembly as recited in claim 21 wherein said plurality of axially extending slots includes at least four slots in the wall of the wire receiving portion of said inner sleeve.

23. An electrical connector assembly as recited in claim 22 wherein said electrical contact assembly includes wire stop means in the bore of the inner sleeve to prevent a wire inserted into the rear wire receiving portion of said inner sleeve from entering into the front portion of said inner sleeve.

24. An electrical connector assembly as recited in claim 23 wherein the wire stop means comprises a radially inwardly extending finger that extends from said intermediate sleeve through the aperture in said inner sleeve and into the bore of said inner sleeve.

25. An electrical connector assembly comprising:

a cylindrical housing;

a dielectric insert mounted within said cylindrical housing, said insert having a plurality of axial bores therein;

means for mounting an electrical contact in each of said axial bores; and a plurality of electrical contact assemblies each mounted in a respective bore by said contact mounting means, said electrical contact assemblies comprising:

a sleeve stamped and formed from a sheet of metal, said sleeve having:

a front pin portion for mating with a socket contact; and a rear wire receiving portion having an unwelded seam and a plurality of axially extending slots in the wall of said sleeve equally spaced from each other with the longitudinal axis of each of said slots parallel to the longitudinal axis of said sleeve; and an outer sleeve located over the rear wire receiving portion of said sleeve.

26. A method of fabricating a socket type electrical connector contact assembly comprising the steps of:

stamping from a sheet of metal, a rectangularly shaped piece having a plurality of longitudinally arranged slots in a rear portion, said slots equally spaced from each other with the longitudinal axis of each of said slots parallel to the longitudinal axis of said rectangular piece and a plurality of fingers extending longitudinally from an opposite front portion;

forming said rectangular piece into a tubular form having an axially extending seam therein;

placing an intermediate sleeve over said tubular form; and placing an outer sleeve over a portion of the intermediate sleeve that surrounds said front portion of the tubular form having the plurality of longitudinally extending fingers.

27. A method of fabricating a socket type electrical connector contact assembly as recited in claim 26 including the steps of:

inserting an electrical conductor into that portion of the bore in the rear portion of the tubular form that has the slots therein, said electrical conductor extending into the bore of the tubular form to a point past the slots; and applying a force to that portion of the intermediate sleeve that will crimp part of the rear portion of the tubular form into the electrical conductor to form an electrical and mechanical connection between said electrical conductor and said tubular form.

28. A method of fabricating a pin type electrical connector contact assembly comprising the steps of:

stamping from a sheet of metal, a piece having a plurality of slots in a rear portion and a plurality of fingers extending from an opposite front portion, said slots equally spaced from each other with the longitudinal axis of each of said slots parallel to the longitudinal axis of one of said fingers; and forming said flat piece into a tubular form having axially extending slots, an axially extending seam and a front pin shaped portion;

placing an outer sleeve over the rear portion of said tubular form having the slots therein; and attaching said outer sleeve to said tubular form.

29. A method of fabricating a pin type electrical connector contact assembly as recited in claim 28 including the steps of:

inserting an electrical conductor into the rear portion of the tubular form having the slots therein; and applying force to said outer sleeve to crimp part of the rear portion of the tubular form having the slots therein into the electrical conductor to form an electrical and mechanical connection between the electrical conductor and said tubular form.

30. A method of fabricating an electrical connector contact adapted to receive an electrical wire, said method comprising the steps of:

stamping from a sheet of metal, a piece having at least four slots in a rear wire receiving portion and a plurality of fingers extending from an opposite front mating portion; and forming said piece into a tubular form having in the wire receiving portion axially extending slots and an axially extending seam therein, each of said slots having a longitudinal axis parallel to the axis of one of said fingers.

* * * * *